US007686099B2

(12) United States Patent
Rodney

(10) Patent No.: US 7,686,099 B2
(45) Date of Patent: Mar. 30, 2010

(54) DOWNHOLE POSITIONING SYSTEM

(75) Inventor: Paul F. Rodney, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 85 days.

(21) Appl. No.: 11/063,812

(22) Filed: Feb. 23, 2005

(65) Prior Publication Data

US 2005/0183887 A1 Aug. 25, 2005

Related U.S. Application Data

(60) Provisional application No. 60/546,862, filed on Feb. 23, 2004.

(51) Int. Cl.
*E21B 44/00* (2006.01)

(52) U.S. Cl. ..... 175/45; 367/25; 367/30; 367/125

(58) Field of Classification Search ..... 367/25, 367/33, 77, 118, 125, 128, 30; 175/45; 166/254.1, 166/255.1
See application file for complete search history.

(56) References Cited

U.S. PATENT DOCUMENTS 3,828,867 A * 8/1974 Elwood ..... 367/14
4,460,059 A * 7/1984 Katz ..... 367/33
4,710,708 A * 12/1987 Rorden et al. ..... 324/207.26
4,791,373 A * 12/1988 Kuckes ..... 324/346
4,875,014 A * 10/1989 Roberts et al. ..... 324/326
4,933,640 A 6/1990 Kuckes
5,031,158 A * 7/1991 Chamuel ..... 367/118
5,218,301 A * 6/1993 Kuckes ..... 324/346
5,585,726 A * 12/1996 Chau ..... 324/326
5,724,308 A * 3/1998 Sorrells et al. ..... 367/34
5,923,170 A * 7/1999 Kuckes ..... 324/326
5,933,008 A * 8/1999 Mercer ..... 324/326
RE36,569 E * 2/2000 Kuckes ..... 324/346
6,411,094 B1 * 6/2002 Gard et al. ..... 324/326
6,424,595 B1 * 7/2002 Chenin ..... 367/82
6,435,286 B1 * 8/2002 Stump et al. ..... 175/26
6,597,169 B2 7/2003 Morroka et al.
6,776,246 B1 * 8/2004 Nickel et al. ..... 175/45
7,006,008 B1 * 2/2006 Bervoets et al. ..... 367/125
2003/0025639 A1 * 2/2003 Rodney et al. ..... 340/856.3

OTHER PUBLICATIONS

Gao et al., Li, U.S. Appl. No. 10/856,439, filed May 28, 2004, entitled "Downhole Signal Source," 21 pgs.
Canadian Office Action dated Nov. 16, 2007, Application No. 2,556,107, titled: A Downhole Positional System; Examiner, William Tse; Based on PCT Int'l App PCT/US2005/005821.

* cited by examiner

*Primary Examiner*—Scott A Hughes
(74) *Attorney, Agent, or Firm*—Mark E. Scott; Conley Rose, P.C.

(57) ABSTRACT

Downhole positioning systems and associated methods are disclosed. In some embodiments, the system comprises a downhole source, an array of receivers, and a data hub. The downhole source transmits an electromagnetic positioning signal that is received by the array of receivers. The data hub collects amplitude and/or phase measurements of the electromagnetic positioning signal from receivers in the array and combines these measurements to determine the position of the downhole source. The position may be tracked over time to determine the source's path. The position calculation may take various forms, including determination of a source-to-receiver distance for multiple receivers in the array, coupled with geometric analysis of the distances to determine source position. The electromagnetic positioning signal may be in the sub-hertz frequency range.

13 Claims, 3 Drawing Sheets

DOWNHOLE POSITIONING SYSTEM

CROSS-REFERENCE TO RELATED APPLICATIONS

The present application claims priority to U.S. Provisional Patent Application 60/546,862, filed Feb. 23, 2004, and titled "Downhole Positioning System". This provisional is hereby incorporated herein by reference.

BACKGROUND

A number of costly and/or hazardous situations can arise from positional uncertainties along a well bore trajectory and from uncertainties of the locations along that trajectory relative to logs of formation properties taken in the same well. In particular, the following are examples of problems that may result from positional errors:

In highly developed fields, positional errors may result in well bore collisions. The intersecting of different well bores may result in undesirable interactions between the activities in different well bores, including damage to tubing strings, and unexpected fluid exchange.

When geosteered drilling is employed in fields with a known geological model, positional errors may result in drilling decision errors. Measured formation properties may be associated with incorrect beds in the model, causing the drillers to steer the well bore trajectory along a misidentified bed or into a misidentified area.

Positional errors can further make operators unable to determine the cause of discrepancies between a geologic model and logs. When such discrepancies are attributable to positional errors, the operator cannot determine whether the model itself is incorrect. (As a byproduct, the difference in resolution between available position measurement techniques and the vertical resolution of most logging while drilling ("LWD") sensors makes it difficult to correlate logs with formation evaluation data used to create the geologic models.)

Most fundamentally, positional errors can prevent a driller from achieving optimal placement of well completions, and may even result in wandering from lease lines. Each of the foregoing issues may reduce the efficiency with which petroleum can be produced from a reservoir.

SUMMARY

The problems outlined above are in large measure addressed by the disclosed downhole positioning systems and associated methods. In some embodiments, the system comprises a downhole source, an array of receivers, and a data hub. The downhole source transmits an electromagnetic positioning signal that is received by the array of receivers. The data hub collects amplitude and/or phase measurements of the electromagnetic positioning signal from receivers in the array and combines these measurements to determine the position of the downhole source. The position may be tracked over time to determine the source's path. The position calculation may take various forms, including determination of a source-to-receiver distance for multiple receivers in the array, coupled with geometric analysis of the distances to determine source position. The electromagnetic positioning signal may be in the sub-hertz frequency range.

BRIEF DESCRIPTION OF THE DRAWINGS

A better understanding of the present invention can be obtained when the following detailed description of the preferred embodiment is considered in conjunction with the following drawings, in which.

Figure 1:
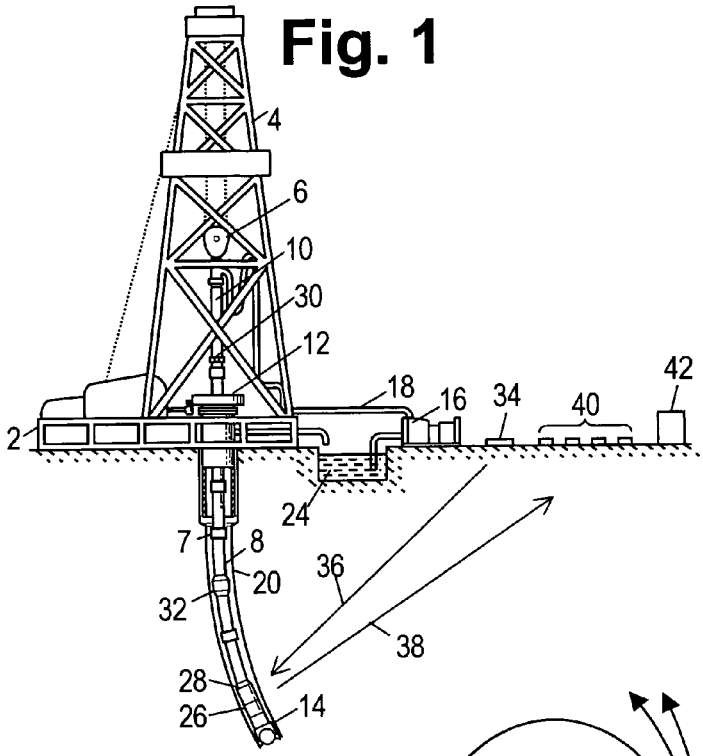
FIG. 1 is an environmental view of an illustrative downhole positioning system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Nomenclature

Certain terms are used throughout the following description and claims to refer to particular system components. This document does not intend to distinguish between components that differ in name but not function. The terms "including" and "comprising" are used in an open-ended fashion, and thus should be interpreted to mean "including, but not limited to . . . ". The term "couple" or "couples" is intended to mean either an indirect or direct electrical, mechanical, or thermal connection. Thus, if a first device couples to a second device, that connection may be through a direct connection, or through an indirect connection via other devices and connections.

DETAILED DESCRIPTION

FIG. 1 shows a drilling platform 2 equipped with a derrick 4 that supports a hoist 6. Drilling of a well bore, for example, the borehole 20, may be carried out by a string of drill pipes 8 connected together by "tool" joints 7 so as to form a drill string. The hoist 6 suspends a kelly 10 that is used to lower the drill string through rotary table 12. Connected to a lower end of the drill string is a drill bit 14. The borehole 20 may be drilled by rotating the drill string and/or by using a downhole motor to rotate the drill bit 14. Drilling fluid, misleadingly referred to as "mud", is pumped by mud recirculation equipment 16 through supply pipe 18, through drilling kelly 10, and down through an interior passageway of the drill string. The mud exits the drill string through apertures (not shown) in the drill bit 14. The mud then travels back up to the surface through the borehole 20 via an annulus 30 between an exterior surface of the drill string and the borehole wall. At the surface, the mud flows into a mud pit 24, from which it may be drawn by recirculation equipment 16 to be cleaned and reused. The drilling mud may serve to cool the drill bit 14, to carry cuttings from the base of the borehole 20 to the surface, and to balance the hydrostatic pressure from the surrounding formation.

The drill bit 14 is part of a bottom-hole assembly that includes a downhole positioning transceiver 26. The bottom-hole assembly may further include various logging while drilling (LWD) tools and a telemetry transceiver 28. If included, the various LWD tools may be used to acquire information regarding the surrounding formations, and the telemetry transmitter 28 may be used to communicate telemetry information to a surface transceiver 30, perhaps via one or more telemetry repeaters 32 periodically spaced along the drill string. In some embodiments, control signals may be communicated from the surface transceiver 30 to the telemetry transceiver 28.

FIG. 1 further shows various components of an illustrative downhole positioning system, in which a reference transmitter 34 transmits a pilot signal 36. The pilot signal 36 serves as a timing reference, and in some embodiments, it is broadcast as a low frequency electromagnetic signal to the downhole positioning transceiver 26 and to receivers in a receiver array 40. In various alternative embodiments, the pilot signal 36 may be transmitted through the borehole by surface transceiver 30, or omitted entirely if extremely accurate timing references are available to the downhole positioning transceiver 26 and the receiver array 40.

The downhole positioning transceiver 26 broadcasts a low frequency electromagnetic signal 38 that is coordinated with the timing reference so as to allow for determination of travel times between the positioning transceiver 26 and the various receivers in array 40. The receivers in array 40 measure the amplitude and phase of electromagnetic signal 38 and communicate their measurements to a data hub 42. In some embodiments, data hub 42 is simply a collection station for gathering and storing receiver array measurements for later analysis. In other embodiments, data hub 42 includes some processing capability for combining measurements from various receivers to determine the position and path of downhole positioning transceiver 26. Though shown as separate components, the reference transmitter 34 and the data hub 42 may be integrated with one or more of the receivers in array 40.

Figure 2:
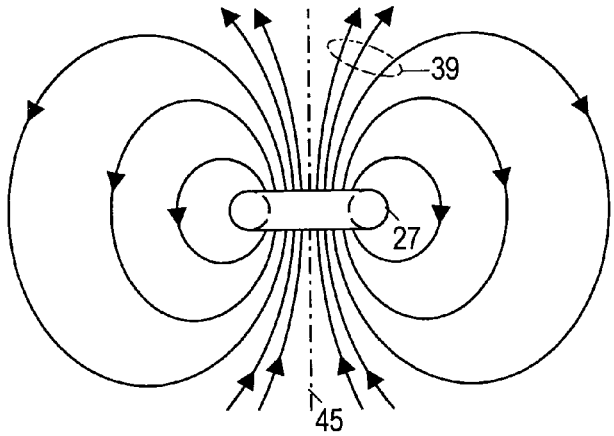
FIG. 2 is a side view of a field pattern for an illustrative magnetic dipole.

Electromagnetic signals 36 and 38 may be transmitted and received using any of many suitable antenna configurations. FIG. 2 shows a magnetic field pattern associated with an illustrative magnetic dipole 27 that comprises many windings of an electrical conductor. As alternating current is passed through the electrical conductor, the magnetic dipole 27 creates an alternating magnetic field pattern in the shape represented by field lines 39. (The field is axially symmetric about axis 45.) In free space, the intensity of the magnetic field is inversely proportional to the distance from the transmitter, and the relative phase of the alternating field varies linearly with distance. Though these factors are influenced by the subsurface earth formations, the field amplitude and phase can still serve as a measure of distance between the downhole positioning transceiver 26 and a receiver in array 40.

Figure 3:
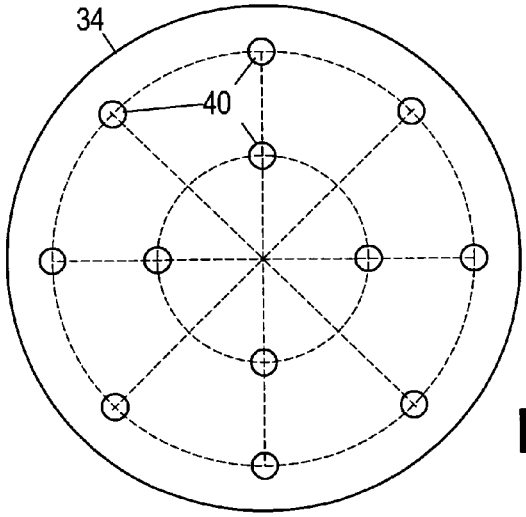
FIG. 3 is a top view of an illustrative layout for a surface transmitter and surface receiver array.

FIG. 3 shows an illustrative layout for a surface transmitter 34 and a surface receiver array. As shown, surface transmitter 34 takes the form of a magnetic dipole. In some embodiments, the surface transmitter 34 comprises a loop with a radius of 100 meters carrying a (pilot signal) current of 10 amperes. The pilot signal current oscillates at a very low frequency, in the range between $10^{-3}$ Hz and 1 Hz. In some embodiments, the frequency is slowly reduced from $10^{-1}$ Hz to $10^{-2}$ Hz as the downhole positioning transceiver travels farther away from the receiver array 40.

The downhole positioning transceiver 26 may be provided with a magnetic field receiving antenna. In some embodiments, this receiving antenna comprises a 5000-turn loop of radius 6.35 cm, wrapped on a core having a relative permeability of 1000. The downhole positioning transceiver 26 detects the pilot signal 36 and generates a low frequency positioning signal that is phase-locked to the pilot signal. To transmit the positioning signal, the downhole positioning transceiver 26 may employ a magnetic dipole transmit antenna 27 having similar characteristics to the receive antenna. In some alternative embodiments, the downhole positioning transceiver may employ a mechanically actuated magnetic dipole transmitter, as disclosed in U.S. patent application Ser. No. 10/856,439, entitled "Downhole Signal Source" and filed May 28, 2004, by inventors Li. Gao and Paul Rodney. The foregoing application is hereby incorporated herein by reference.

The receivers in array 40 may each include a three-axis magnetometer. In some embodiments, the magnetometers may be provided with accelerometers for motion compensation. In some alternative embodiments, each receiver may include superconducting quantum interference devices ("SQUIDs") for measuring magnetic field intensities. Each receiver measures an amplitude and phase (with respect either to a fixed point in the array of surface receivers, or with respect to the pilot signal 36) of the received positioning signal. The receivers in array 40 are positioned apart to allow the measurements to be used for a geometric determination of the positioning of the signal source, i.e. downhole positioning transceiver 26. The array 40 may include a minimum of three receivers (two may be sufficient when constraints are placed on the borehole path), but improved positioning accuracy may be expected as the number of receivers is increased. The co-linearity of the receivers should be minimized within the constraints of feasibility.

Figure 4:
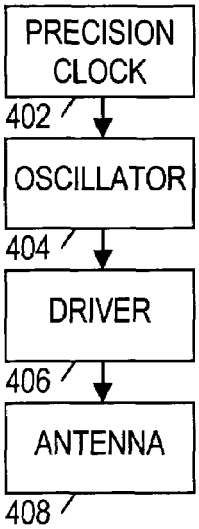
FIG. 4 is a functional block diagram of an illustrative reference transmitter.

FIG. 4 shows a block diagram of an illustrative reference transmitter. A precision clock 402 produces an extremely stable and accurate clock signal. An oscillator 404 converts the clock signal into a sinusoidal signal having a predetermined frequency (e.g., 0.1 Hz). A driver 406 amplifies the sinusoidal signal and powers an antenna 408 to transmit a pilot signal 36 (FIG. 1). Antenna 408 may be a magnetic dipole, as discussed previously, but may also take other suitable forms including an electric dipole or an electric monopole.

Figure 5:
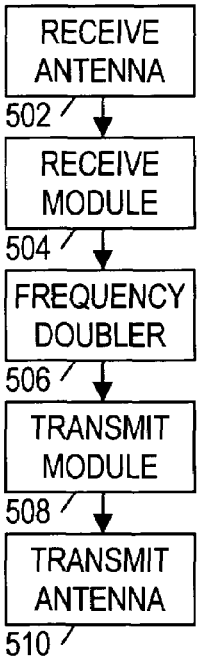
FIG. 5 is a functional block diagram of an illustrative downhole transceiver.

FIG. 5 shows a block diagram of an illustrative downhole positioning transceiver. A receive antenna 502 is coupled to a receive module 504 that detects the pilot signal 36. A frequency multiplier 506 shifts the frequency of the detected pilot signal to generate a positioning signal that is synchronized to the pilot signal. In an alternative embodiment, a frequency divider may be used for frequency shifting. A small multiplication or division factor (e.g, two or three) may be preferred to keep both signals in the low-frequency range. A transmit module 508 amplifies the positioning signal and powers a transmit antenna 510 to transmit the positioning signal 38 (FIG. 1). In some embodiments, the receive and transmit antennas may be one and the same, while in other embodiments, the two antennas may be separated and/or orthogonally oriented. The transmit antenna 510 may take the form of a magnetic dipole, an electric dipole, or a mechanically actuated magnetic source.

Figure 6:
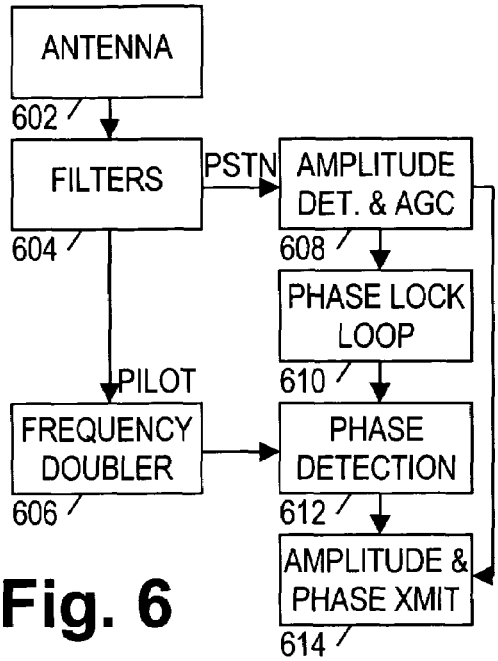
FIG. 6 is a functional block diagram of an illustrative surface receiver.

FIG. 6 shows a block diagram of an illustrative receiver in array 40. An antenna 602 receives a combination of the pilot signal 36 and the positioning signal 38. Filters 604 separate the two signals based on their different frequencies. The pilot signal is frequency shifted by a frequency multiplier 606 (or a frequency divider) to reproduce the operation of downhole positioning transceiver 26. The positioning signal is processed by an amplitude detector module 608 that determines the received amplitude of the positioning signals and amplifies the positioning signal to a predetermined amplitude (automatic gain control). A phase-lock loop 612 generates a "clean" oscillating signal that is phase-locked to the amplified positioning signal. A phase detector 612 determines the phase difference between the clean oscillating signal from phase-lock loop 612 and the reproduced positioning signal from frequency multiplier 606. The phase difference and amplitude measurement are sent by an interface 614 to the data hub 42 (FIG. 1).

Figure 8:
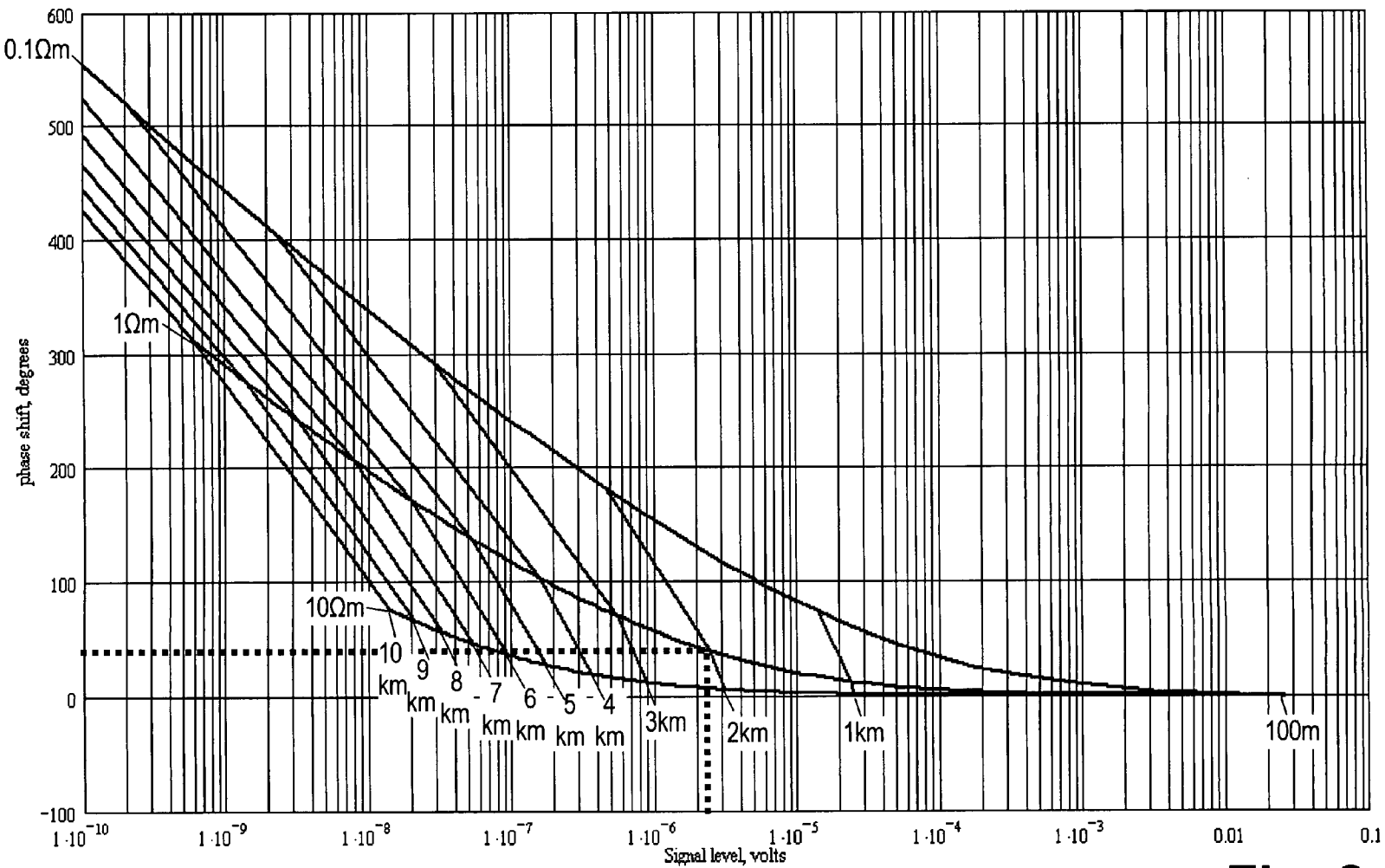
FIG. 8 is an illustrative chart of phase shift vs. signal level for different formation resistivities and downhole transmitter/surface receiver spacings.

FIG. 8 shows how a phase difference and amplitude measurement may be used to calculate a signal source's distance from the receiver making those measurements. Although the illustrative chart applies to an alternative embodiment of the downhole positioning system, the principles are applicable to embodiments shown in the foregoing figures. FIG. 8 shows three curves of phase measurement as a function of amplitude for homogenous formations with three different resistivities: 0.1 Ωm, 1 Ωm, and 10 Ωm. Connecting these curves are eleven cross-lines representing different distances between the source and receiver: 100 m, 1 km, 2 km, 3 km, . . . , 10 km. As shown by the dotted lines, a measurement of signal amplitude ($2.5\times10^{-6}$ volts) and phase shift (45°) for a given positioning signal frequency corresponds to a unique combination of resistivity (1 Ωm) and distance (2 km). These curves and lines can be parameterized to allow similar determinations for points not falling directly on the lines.

In non-homogenous formations, the resistivities of different formation components may be essentially "averaged" together by the propagating electromagnetic waves. Accordingly, phase and amplitude measurements may indicate an effective resistivity, i.e., the resistivity for a homogenous formation that would produce similar measurements.

Figure 7:
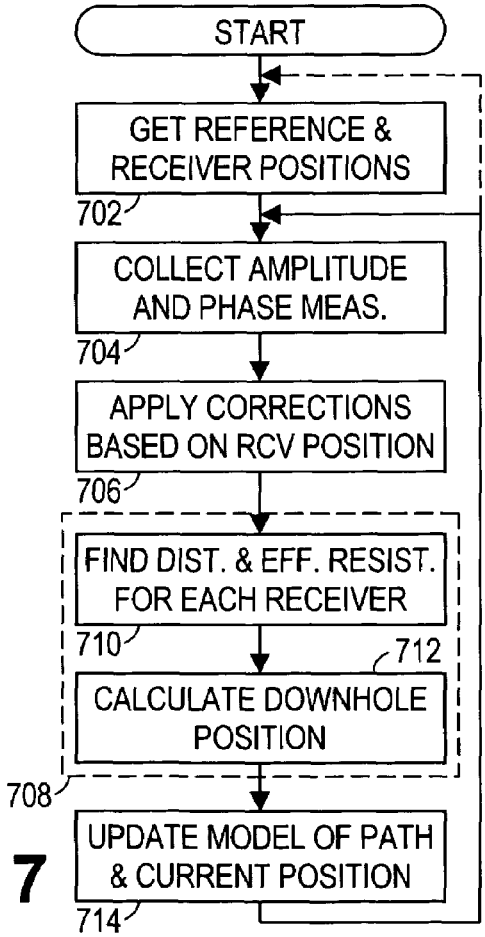
FIG. 7 is a flow diagram of an illustrative downhole positioning method.

FIG. 7 shows an illustrative downhole positioning method that may be employed by the data hub 42 or by a computer processing data collected by the hub. The method comprises a loop to provide tracking of the downhole positioning transceiver 26. In block 702 the current positions of the reference transmitter 34 and each of the receivers in array 40 are determined. In some embodiments, these positions may be determined by global positioning system (GPS) receivers integrated with the corresponding components. In other embodiments, these positions may be determined using traditional surveying techniques. In system configurations that allow motion of the surface transmitter 34 and/or the receivers, these positions are periodically re-determined.

In block 704, the current amplitude and phase measurements are collected from each of the receivers in array 40. In block 706, an amplitude correction is applied to the amplitude measurements to compensate for variations in receiver characteristics. In addition, a phase correction is applied to each of the phase measurements. The phase correction compensates not only for the variations in receiver characteristics, but also for the individual propagation delays of the pilot signal from the reference transmitter to the various receivers. In some embodiments, an additional adaptive phase correction may be determined to compensate for the propagation delay of the pilot signal from the reference transmitter to the downhole positioning transceiver. This additional phase correction is a function of the effective resistivity and magnetic permeability of the material between the reference transmitter and the downhole positioning transceiver, and it changes as the downhole positioning transceiver moves relative to the transmitter and receivers. The additional phase correction may be applied to each of the phase measurements or simply included as a parameter in the position calculations.

In block 708, the transceiver's downhole position is calculated from the amplitude and (corrected) phase measurements. Some embodiments may perform this calculation as shown in the figure, but a number of algorithms may be employed for this calculation. In some embodiments, resistivity determinations are monitored as a function of position and are used to construct a model of the subsurface structure. The effects of the model are then taken into account for subsequent position calculations. In these and other embodiments, array processing techniques may be employed to estimate positioning signal wavefronts and to calculate the signal source position from these estimates.

In block 710, a distance and effective resistivity determination is made for the measurements from each receiver. This may be done as described previously with respect to FIG. 8. In block 712, a geometrical analysis is performed on the various distance measurements to determine the downhole transceiver's position.

In block 714, the calculated position is used to update a current position measurement. (The current position measurement may be determined from a weighted average of recent position measurements.) The updated position measurement may in turn be used to update a model of the transceiver's path. As the transceiver 26 travels along the borehole, the measured positions will trace a path in three-dimensional space. The path segments between position measurements may be estimated by interpolation.

The loop is repeated to track the position and trajectory of the transceiver 26. Though the transceiver's source may operate at very low (sub-hertz) frequencies, it is desirable to employ oversampling (or even analog processing) to enhance phase detection accuracy. Accordingly, it is expected that the measurement and calculation rate will be significantly higher than the signal frequency, e.g., a sampling rate of 1-10 Hz. Such oversampling may also allow the foregoing methods to be applied to wireline applications with relatively high transceiver speeds (e.g., 1 m/s).

The methods described above can be implemented in the form of software, which may be communicated to a computer or other processing system on an information storage medium such as an optical disk, a magnetic disk, a flash memory, or other persistent storage device. Alternatively, such software may be communicated to the computer or processing system via a network or other information transport medium. The software may be provided in various forms, including interpretable "source code" form and executable "compiled" form.

In various alternative embodiments, the downhole positioning system may comprise multiple sources on the surface transmitting at different frequencies below 1 Hz. The downhole transceiver 26 may make amplitude and/or phase measurements of the electromagnetic signals from the sources to allow for distance determinations to each of the sources and a consequent position determination from these distances.

Numerous variations and modifications will become apparent to those skilled in the art once the above disclosure is fully appreciated. For example, in some embodiments the timing reference (and phase differences) may be eliminated, and the distance calculation may be based purely on signal amplitudes measured by the receiver array. It is intended that the following claims be interpreted to embrace all such variations and modifications.

What is claimed is:

1. A downhole positioning method that comprises:

transmitting an electromagnetic positioning signal from a source in a borehole, the electromagnetic positioning signal derived from a pilot signal transmitted from a device proximate to the surface;

receiving at each of multiple receivers the electromagnetic positioning signal from the source in a borehole; and combining positioning signal measurements collected from the electromagnetic positioning signal at each of the receivers to determine a position of the source, each of the positioning signal measurements are indicative of a magnitude and a phase of the electromagnetic positioning signal at each respective receiver.

2. The method of claim 1, further comprising:

tracking the position of the source to identify a borehole trajectory.

3. The method of claim 1, wherein said combining further comprises:

determining for each receiver a source-to-receiver distance; and calculating the source's position from the source-to-receiver distances.

4. The method of claim 1, further comprising:

receiving at each of the multiple receivers the pilot signal from the device proximate to the surface;

deriving a reference signal from the pilot signal.

5. The method of claim 4, further comprising:

comparing the electromagnetic positioning signal at each receiver to the reference signal to measure a phase difference.

6. The method of claim 5, further comprising:

compensating for pilot signal propagation times by correcting the phase difference.

7. The method of claim 1, further comprising:

measuring an amplitude of the electromagnetic positioning signal at each receiver using a three-axis magnetometer.

8. The method of claim 1, wherein transmitting the electromagnetic positioning signal further comprises transmitting the electromagnetic positioning signal with a frequency less than about 1 hertz.

9. The method of claim 1, wherein transmitting the electromagnetic positioning signal from the source comprises a magnetic dipole source.

10. The method of claim 1, wherein transmitting the pilot signal from the device proximate to the surface further comprises propagating an electromagnetic signal by way of a formation surrounding the borehole, the electromagnetic signal propagating from the device proximate to the surface to the source in the borehole.

11. A method comprising:

transmitting an electromagnetic positioning signal from a source in a borehole, the electromagnetic positioning signal derived from a pilot signal transmitted from a device proximate to the surface;

receiving at each of multiple receivers the electromagnetic positioning signal from the source in a borehole, and the pilot signal from the device proximate to the surface; and combining positioning signal measurements collected from the electromagnetic positioning signal at each of the receivers to determine a position of the source, each of the positioning signal measurements are indicative of a magnitude and a phase of the electromagnetic positioning signal at each respective receiver.

12. The method of claim 11, further comprising deriving a reference signal from the pilot signal.

13. The method of claim 11, wherein transmitting the pilot signal from the device proximate to the surface further comprises propagating an electromagnetic signal by way of a formation surrounding the borehole, the electromagnetic signal propagating from the device proximate to the surface to the source in the borehole.

* * * * *